US007640926B2

(12) United States Patent
Jones

(10) Patent No.: US 7,640,926 B2
(45) Date of Patent: Jan. 5, 2010

(54) PNEUMATIC ASSEMBLY FOR A PAINTBALL GUN

(75) Inventor: Danial Jones, Latrobe, PA (US)

(73) Assignee: Smart Parts, Inc., Loyalhanna, PA (US)

( * ) Notice: Subject to any disclaimer, the term of this patent is extended or adjusted under 35 U.S.C. 154(b) by 385 days.

(21) Appl. No.: 11/305,393

(22) Filed: Dec. 16, 2005

(65) Prior Publication Data

US 2006/0090739 A1 May 4, 2006

Related U.S. Application Data

(63) Continuation-in-part of application No. 10/773,537, filed on Feb. 5, 2004, now Pat. No. 7,044,119, which is a continuation-in-part of application No. 10/695,049, filed on Oct. 27, 2003, now Pat. No. 7,185,646.

(51) Int. Cl.
*F41B 11/00* (2006.01)

(52) U.S. Cl. ..... 124/74
(58) Field of Classification Search ..... 124/71–77
See application file for complete search history.

(56) References Cited

U.S. PATENT DOCUMENTS 2,304,320 A 12/1942 Tratsch ..... 124/77

(Continued)

FOREIGN PATENT DOCUMENTS

EP 94026535 2/1993

(Continued)

OTHER PUBLICATIONS

Matrix-Main Body Assembly & Parts Listing at http://www.directpaintball.com/pics/diablomatrix/matrixparts.gif. 3 pages.

(Continued)

*Primary Examiner*—Troy Chambers
(74) *Attorney, Agent, or Firm*—Simple IP Law, P.C.; Craig R. Rogers

(57) ABSTRACT

A pneumatic assembly for a paintball gun preferably includes a bolt slidable between an open and a closed position. The bolt preferably provides a firing mechanism for the paintball gun by permitting compressed gas to flow through the bolt to fire the paintball gun when the bolt is closed but preventing the transfer of compressed gas through the bolt when the bolt is open. This can be accomplished, for instance, by arranging a sealing member in communication with a surface of the bolt. A port is also preferably arranged through a lateral sidewall of the bolt at a predetermined location. The bolt preferably slides in relation to the sealing member such that when the bolt is open, the sealing member prevents compressed gas from flowing into the forward end of the bolt, but when the bolt is closed, compressed gas is permitted to flow into the forward end of the bolt to launch a paintball. The bolt is preferably controlled by using a control valve such as a three-way solenoid valve to operate a pneumatic piston. The piston can include a larger surface area on one end of the piston to selectively receive a supply of compressed gas from the solenoid valve and a smaller surface area receiving a constant supply of compressed gas. A single supply port in the pneumatic cylinder can be used to supply compressed gas to both the pneumatic piston and the compressed gas storage chamber. A supply of compressed gas to the compressed gas storage area can be cut off during firing to improve gas efficiency.

15 Claims, 12 Drawing Sheets

U.S. PATENT DOCUMENTS

| | | | | |
|---|---|---|---|---|
| 2,554,116 | A | 5/1951 | Monner | 124/11 |
| 2,568,432 | A | 9/1951 | Cook | 124/77 |
| 2,594,240 | A | 4/1952 | Wells | 124/13 |
| 2,634,717 | A | 4/1953 | Junkin | 124/11 |
| 2,817,328 | A | 12/1957 | Gale | 124/74 |
| 2,834,332 | A | 5/1958 | Guthrie | 124/77 |
| 2,845,055 | A | 7/1958 | Collins et al. | 124/32 |
| 2,845,805 | A | 7/1958 | Collins et al. | 124/77 |
| 3,089,476 | A | 5/1963 | Wolverton | 124/77 |
| 3,192,915 | A | 7/1965 | Norris et al. | 124/77 |
| 3,662,729 | A | 5/1972 | Henderson | 124/73 |
| 3,695,246 | A | 10/1972 | Filippi et al. | 124/77 |
| 3,921,980 | A | 11/1975 | Artzer | 124/77 |
| 4,009,536 | A | 3/1977 | Wolff | 42/84 |
| 4,038,961 | A | 8/1977 | Olofsson | 124/69 |
| 4,094,294 | A | 6/1978 | Speer | 124/56 |
| 4,269,163 | A | 5/1981 | Feith | 124/77 |
| 4,362,145 | A | 12/1982 | Stelcher | 124/32 |
| 4,730,407 | A | 3/1988 | DeCarlo | 42/84 |
| 4,770,153 | A | 9/1988 | Edelman | 124/77 |
| 4,819,609 | A | 4/1989 | Tippmann | 124/72 |
| 4,899,717 | A | 2/1990 | Rutten et al. | 124/32 |
| 4,936,282 | A | 6/1990 | Dobbins et al. | 124/74 |
| 5,063,905 | A | 11/1991 | Farrell | 124/72 |
| 5,083,392 | A | 1/1992 | Bookstaber | 42/84 |
| 5,228,427 | A | 7/1993 | Gardner, Jr. | 124/71 |
| 5,261,384 | A | 11/1993 | Hu | 124/66 |
| 5,280,778 | A | 1/1994 | Kotsiopoulos | 124/73 |
| 5,285,765 | A | 2/1994 | Lee | 124/50 |
| 5,333,594 | A | 8/1994 | Robinson | 124/73 |
| 5,335,594 | A | 8/1994 | Karlyn et al. | 101/35 |
| 5,337,726 | A | 8/1994 | Wood | 124/61 |
| 5,349,938 | A | 9/1994 | Farrell | 124/73 |
| 5,383,442 | A | 1/1995 | Tippmann | 124/76 |
| 5,413,083 | A | 5/1995 | Jones | 124/32 |
| 5,462,042 | A | 10/1995 | Greenwell | 124/76 |
| 5,497,758 | A | 3/1996 | Dobbins et al. | 124/73 |
| 5,515,838 | A | 5/1996 | Anderson | 124/76 |
| 5,613,483 | A | 3/1997 | Lukas et al. | 124/73 |
| 5,769,066 | A | 6/1998 | Schneider | 124/75 |
| 5,778,868 | A | 7/1998 | Shepherd | 124/76 |
| 5,878,736 | A | 3/1999 | Lotuaco, III | 124/71 |
| 5,881,707 | A | 3/1999 | Gardner, Jr. | 124/77 |
| 5,967,133 | A | 10/1999 | Gardner, Jr. | 124/77 |
| 6,003,504 | A | 12/1999 | Rice et al. | 124/73 |
| 6,035,843 | A | 3/2000 | Smith et al. | 124/77 |
| 6,142,136 | A | 11/2000 | Velasco | 124/71 |
| 6,343,599 | B1 | 2/2002 | Perrone | 124/33 |
| 6,349,711 | B1 | 2/2002 | Perry et al. | 124/73 |
| 6,474,326 | B1 | 11/2002 | Smith et al. | 124/77 |
| 6,516,791 | B2 | 2/2003 | Perrone | 124/77 |
| 6,520,172 | B2 | 2/2003 | Perrone | 124/74 |
| 6,557,542 | B1 | 5/2003 | Orr | 124/70 |
| 6,626,165 | B1 | 9/2003 | Bhogal | 124/77 |
| 6,637,421 | B2 | 10/2003 | Smith et al. | 124/77 |
| 6,644,295 | B2 | 11/2003 | Jones | 124/77 |
| 6,644,296 | B2 | 11/2003 | Gardner, Jr. | 124/77 |
| 6,782,652 | B1 * | 8/2004 | Erickson | 42/143 |
| 6,820,606 | B1 | 11/2004 | Duffey | 124/31 |
| 2001/0042543 | A1 | 11/2001 | Perrone | 124/77 |
| 2002/0046748 | A1 | 4/2002 | Hernandez | 124/73 |
| 2002/0096164 | A1 | 7/2002 | Perrone | 124/77 |
| 2002/0170551 | A1 | 11/2002 | Kotsiopoulos et al. | 124/54 |
| 2003/0005918 | A1 | 1/2003 | Jones | 124/70 |
| 2003/0094167 | A1 * | 5/2003 | Nibecker, Jr. | 124/64 |
| 2004/0255923 | A1 | 12/2004 | Carnall et al. | 124/73 |
| 2005/0115551 | A1 | 6/2005 | Carnall et al. | 124/71 |
| 2005/0194558 | A1 * | 9/2005 | Carnall et al. | 251/344 |
| 2005/0235976 | A1 * | 10/2005 | Carnall | 124/73 |

FOREIGN PATENT DOCUMENTS

| | | |
|---|---|---|
| GB | 2146416 | 4/1985 |
| GB | 2313655 | 12/1997 |
| GB | 2391925 | 2/2004 |
| JP | 1179898 | 7/1989 |
| JP | 7004892 | 1/1995 |
| WO | WO 97/26498 | 6/1997 |

OTHER PUBLICATIONS

Techno Paintball- information reviews articles forum auction and chat at http://www.technopaintball.com/matrixreview.htm 2pages.

* cited by examiner

PNEUMATIC ASSEMBLY FOR A PAINTBALL GUN

This application is a continuation-in-part of U.S. patent application Ser. No. 10/773,537, filed Feb. 5, 2004, now U.S. Pat. No. 7,044,119, which is a continuation-in-part of U.S. patent application Ser. No. 10/695,049, filed Oct. 27, 2003, now U.S. Pat. No. 7,185,646, the contents of each of which are incorporated herein by reference in their entirety.

BACKGROUND OF THE INVENTION

1. Field of the Invention

This invention relates generally to pneumatic paintball guns ("markers") and their operating components. More particularly, this invention relates to pneumatic components used to load and fire paintball markers.

2. Related Art

In the sport of paintball, it is generally desirable to have a marker that is as small and light as possible. Smaller and lighter markers increase a players' mobility. Players benefit from increased mobility by being able to move more quickly from bunker to bunker, making it easier to avoid being hit. Further, in the sport of paintball, the marker is treated as an extension of the body such that a hit to the marker counts as a hit to the player. It is desirable, therefore, to have a paintball gun with as small a profile as possible while substantially maintaining or improving performance characteristics of the marker, such as firing rate, accuracy, and gas efficiency. The size of the paintball gun is generally related to the size and number of operating components that must be housed within the paintball gun body.

SUMMARY OF THE INVENTION

In one embodiment of the present invention, a pneumatic assembly for a paintball gun includes a compressed gas storage chamber and a bolt. The storage chamber can be configured to receive a regulated supply of compressed gas. The bolt is preferably configured to slide back and forth between an open (preferably rearward) and a closed (preferably forward) position to load a paintball into a breech of the paintball gun and to control the release of compressed gas from the compressed gas storage area into the bolt to launch the paintball.

To reduce the size and complexity of the paintball gun, the bolt can be configured to provide the firing mechanism of the pneumatic assembly. More particularly, one or more ports are preferably disposed through a lateral wall of the bolt at a predetermined distance from an end of the bolt. The bolt port(s) are preferably arranged to selectively permit the transfer of compressed gas into the bolt from a compressed gas storage area. Most preferably, the bolt port(s) are configured to convey compressed gas into the bolt when the bolt is disposed in a closed position, but not when the bolt is in an open position. This can be accomplished in any number of different ways.

For example, a sealing member can be arranged in communication with the bolt at a predetermined distance from a front portion of the assembly. The sealing member preferably keeps compressed gas from passing through the bolt port(s) into the bolt when the bolt is in an open position. In a closed position, however, compressed gas is allowed to pass through the port(s) into the bolt and then out bolt release ports on the front of the bolt to launch a paintball.

In one specific embodiment, for example, the bolt can be arranged on a valve stem. A sealing member is preferably arranged on a forward end of the valve stem in communication with an internal surface of the bolt. In another embodiment, a sealing member could be arranged in communication with an external surface of the bolt at a predetermined distance from the front of the assembly. As the bolt travels toward its closed position, the bolt port(s) preferably slide past the sealing member and permit compressed gas to flow from the compressed gas storage area into the bolt.

According to another aspect of the present invention, a paintball gun preferably includes a body having a breech. A pneumatic assembly is arranged in the body and preferably includes a compressed gas storage chamber and a bolt. The bolt is preferably configured to move to a closed position in the breech to move a paintball into a firing position and to cause compressed gas to be released through the bolt into the breech.

Interchangeable compressed gas storage chambers can be provided having varying internal volumes. These chambers can be color-coded and/or provided with other visual indicia that correspond to their volumes. A viewing aperture can be provided through a lateral wall of the paintball gun body to permit viewing of the storage chamber or other internal components.

The paintball gun may also include a control valve, such as an electronic solenoid valve or a mechanical valve configured to initiate forward movement of the bolt in response to a trigger pull. The control valve can also be used to control rearward movement of the bolt. An electronic eye can also be arranged in the paintball gun in a manner such that no external wiring is required.

According to still another aspect of the present invention, a pneumatic assembly for a paintball gun can use a controlled volume of compressed gas to launch a paintball. This can be accomplished, for instance, by supplying the compressed gas to the compressed gas storage chamber through a gas supply port arranged in an internal bolt guide. When the bolt is in a rearward position, bolt apertures communicate compressed gas from the supply port to the compressed gas storage chamber. At the same time, one or more sealing members prevent compressed gas from escaping from the bolt. When the bolt is in a forward position, one or more sealing members preferably substantially cut off the supply of compressed gas from the supply port to the compressed gas storage chamber. At the same time, the compressed gas in the storage chamber is released through the bolt apertures to launch a paintball.

Other embodiments can also provide a controlled quantity of compressed gas to launch a paintball. For example, compressed gas can be supplied to a compressed gas storage chamber of a pneumatic assembly through a gas supply port in the pneumatic assembly when a bolt is in a rearward position. A sealing member can be provided to substantially cut off the supply of compressed gas to the storage chamber when the bolt is in its forward position.

In one such embodiment, the sealing member can be arranged around the bolt, with the gas input port arranged near a forward portion of the pneumatic assembly. When the bolt is closed, gas is prevented or restricted from entering the compressed gas storage chamber. When the bolt is open, gas from the supply port is free to enter the compressed gas storage area. As an added benefit of this configuration, gas from the supply port can assist in opening the bolt for a loading operation.

Bolt ports for communicating compressed gas from the compressed gas storage chamber during a firing operation can be configured to permit an internal bolt area to function as part of the compressed gas storage area. Elongated bolt ports and/or additional bolt ports, for instance, can be configured to permit communication between an intermediate area, located between the bolt and the bolt guide, and the compressed gas storage chamber during a firing operation. The elongated bolt ports could, for example, extend beyond opposite sides of a sealing member. An increased volume of gas can thereby be made available to fire the paintball gun, enabling operation at lower pressure, without an increase in the overall size of the pneumatic assembly.

In yet another embodiment illustrating additional inventive principles, a three-way solenoid valve can be used to operate the pneumatic assembly by controlling the supply and release of compressed gas to an end of the pneumatic cylinder. For instance, a constant supply of compressed gas can be supplied to a forward end of the pneumatic cylinder and applied to a smaller piston surface area to drive the bolt rearward. The three-way solenoid valve can be used to selectively supply compressed gas to a larger, rearward surface area during a firing operation to drive the bolt forward by overcoming the force applied to the forward surface area. Use of a three-way solenoid valve can improve the gas efficiency of the pneumatic cylinder.

Compressed gas can further be conserved by sealing off the supply of compressed gas to the compressed gas storage area during the firing operation in this embodiment. Channels can be formed, for instance, to permit an input port for the pneumatic cylinder to also supply compressed gas to the compressed gas storage chamber when the bolt is in a rearward position. When the bolt is moved forward, the channel can be closed to prevent or restrict the supply of compressed gas into the compressed gas storage area. The size of the pneumatic assembly can also be reduced as compared to other embodiments by utilizing the same port to supply compressed gas to the piston and to the compressed gas storage chamber.

Various other aspects, embodiments, and configurations of this invention are also possible without departing from the principles disclosed herein. This invention is therefore not limited to any of the particular aspects, embodiments, or configurations described herein.

BRIEF DESCRIPTION OF THE DRAWINGS

The foregoing and additional objects, features, and advantages of the present invention will become more readily apparent from the following detailed description of preferred embodiments, made with reference to the accompanying figures, in which.

DETAILED DESCRIPTION OF PREFERRED EMBODIMENTS

Figure 1A:
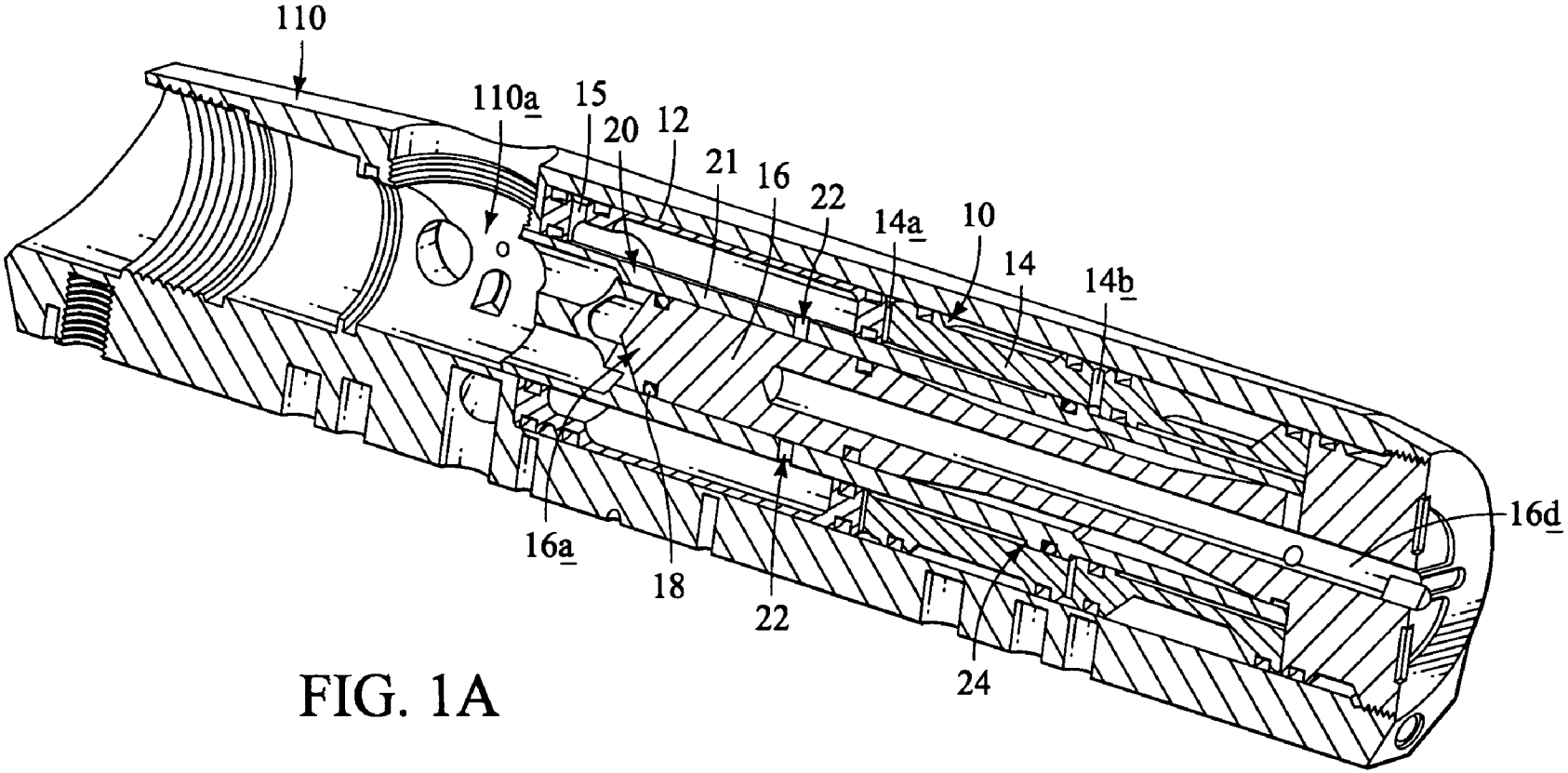
FIG. 1A is a cross-sectional perspective view of a paintball gun body and pneumatic assembly, with a bolt thereof in an rearward (e.g., open) position, according to certain principles of the present invention.

The accompanying drawings show the construction of various preferred embodiments incorporating principles of the present invention. Referring first to FIGS. 1A, 1B, 2A, and 2B, a pneumatic assembly 10 for a paintball gun is preferably configured to be housed within a single chamber or bore of a paintball gun body 110. The pneumatic assembly 10 preferably includes a compressed gas storage chamber 12 configured to store compressed gas for a firing operation, and a pneumatic cylinder 14. A bolt 20 preferably extends longitudinally through at least a portion of the compressed gas storage chamber 12. The bolt 20 can be coupled to, or formed integrally with, a piston 24 that is slidably arranged in the pneumatic cylinder 14. The bolt 20 can be slidably mounted on a bolt guide (or valve stem) 16 and preferably comprises one or more ports 22 arranged through a lateral sidewall 21 of the bolt 20. The valve stem 16 can comprise a sealing member 18 arranged on a forward end 16*a* thereof.

Figure 1B:
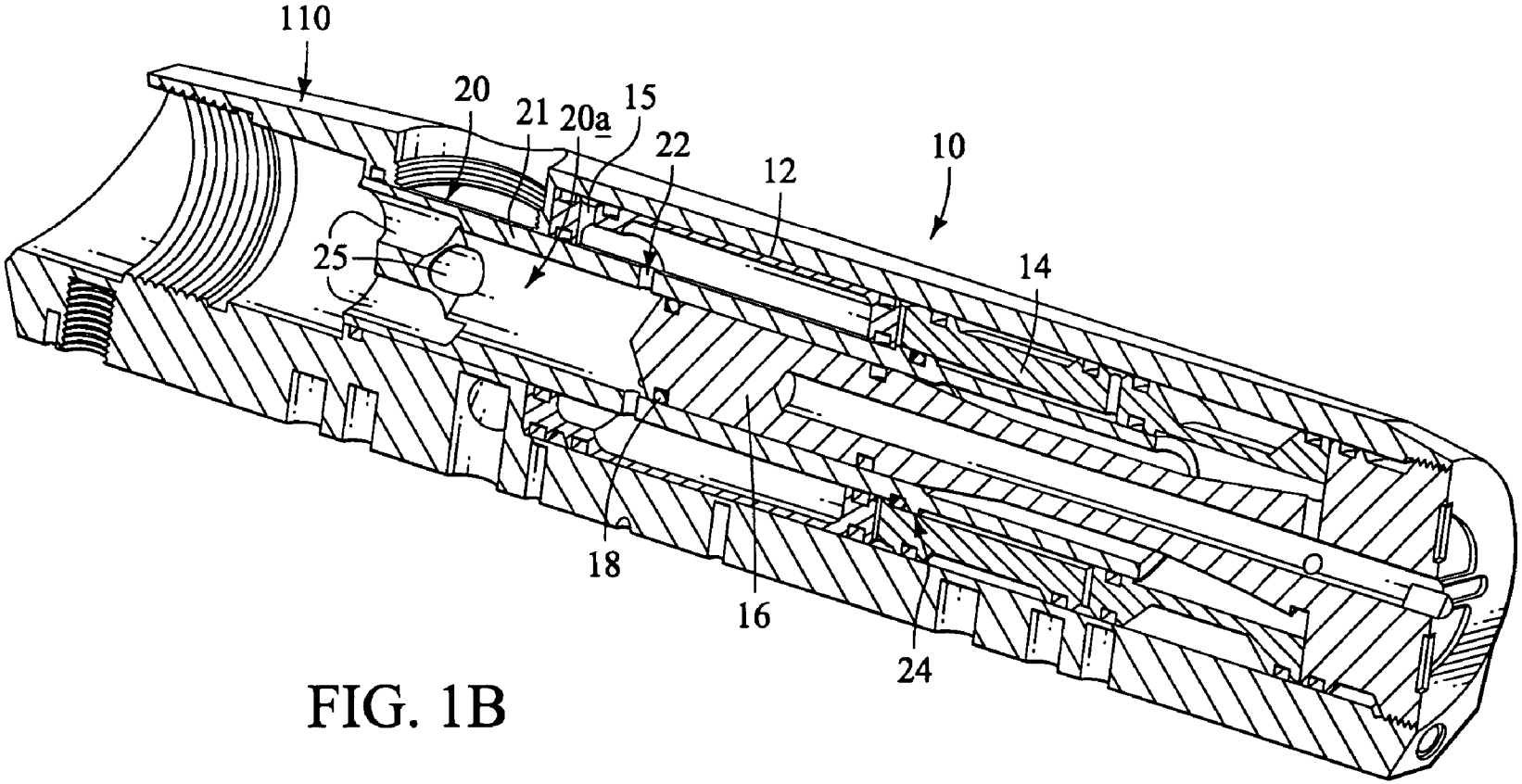
FIG. 1B is a cross-sectional perspective view of the paintball gun body and pneumatic assembly of FIG. 1A, wherein the bolt is disposed in a forward (e.g., closed) position.
Figure 2A:
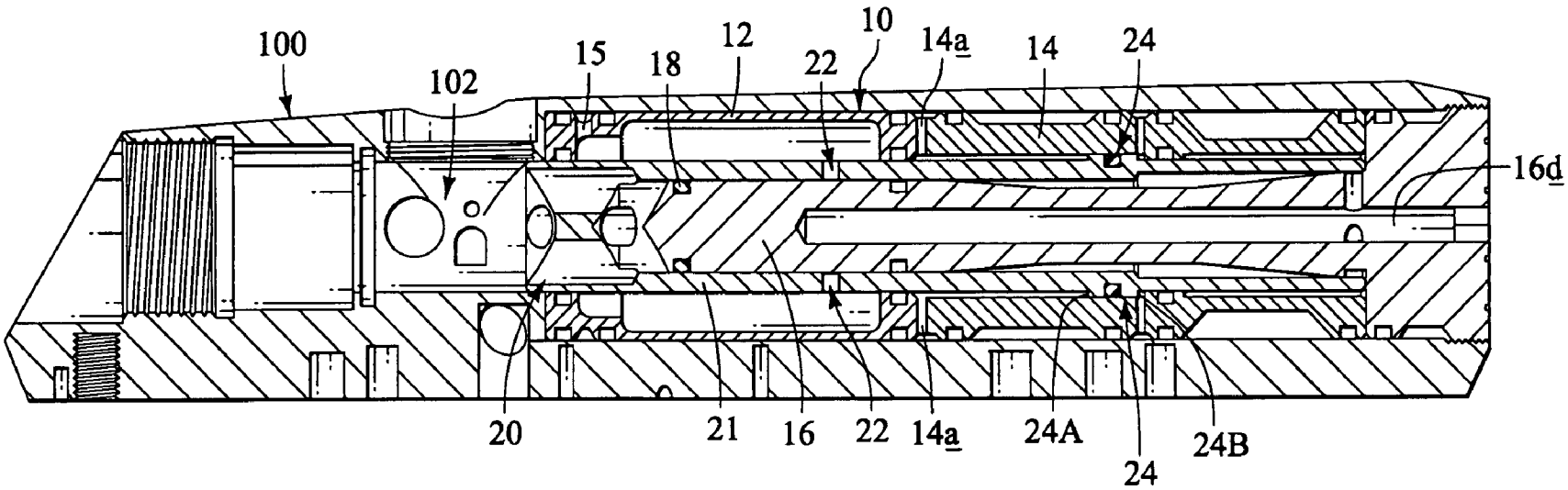
FIG. 2A is a cross-sectional side view of the paintball gun body and pneumatic assembly of FIG. 1A.
Figure 2B:
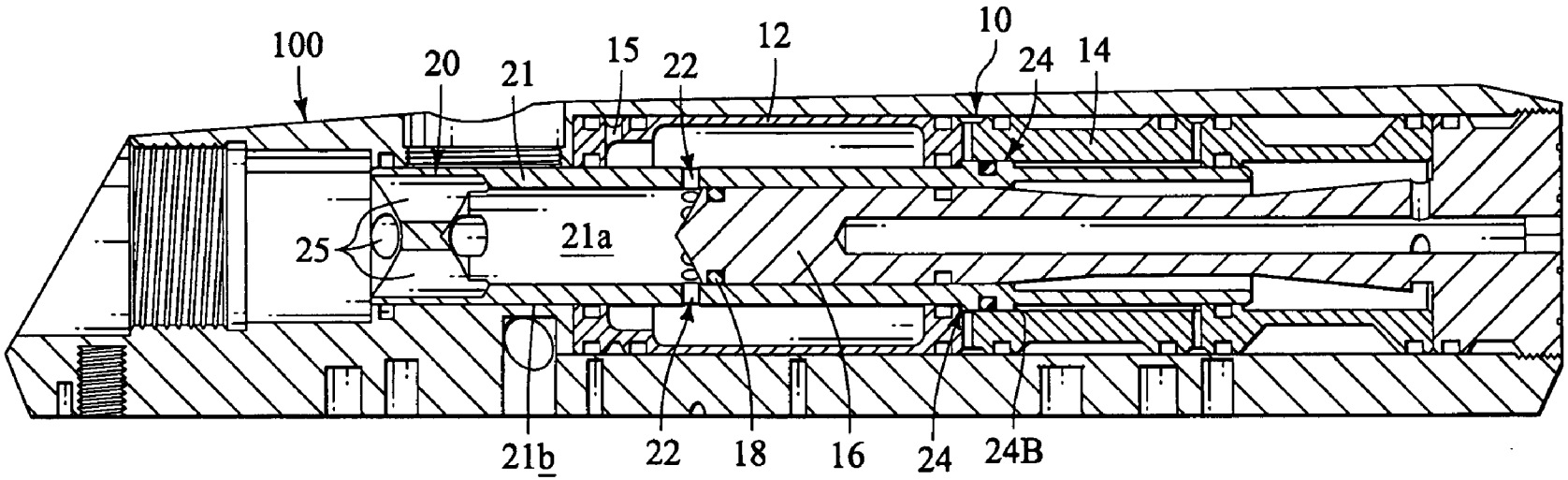
FIG. 2B is a cross-sectional side view of the paintball gun body and pneumatic assembly of FIG. 1B.

In this embodiment, when the bolt 20 is open (e.g., rearward), as shown in FIGS. 1A and 2A, the sealing member 18 prevents compressed gas from flowing through the bolt ports 22 into the bolt 20. When the bolt 20 is closed (e.g., in a forward position), as shown in FIGS. 1B and 2B, however, compressed gas from the compressed gas storage chamber 12 is permitted to flow through the bolt ports 22 into a forward area 20*a* of the bolt 20. Movement of the pneumatic piston 24, and hence movement of the bolt 20, can be controlled by directing compressed gas to, and venting compressed gas from, alternating sides of the pneumatic piston 24 through cylinder ports 14*a*, 14*b*. A vent 16*d* can be provided through a rearward end of the valve stem 16 (or other location) to prevent pressure build-up behind the bolt 20.

Figure 3A:
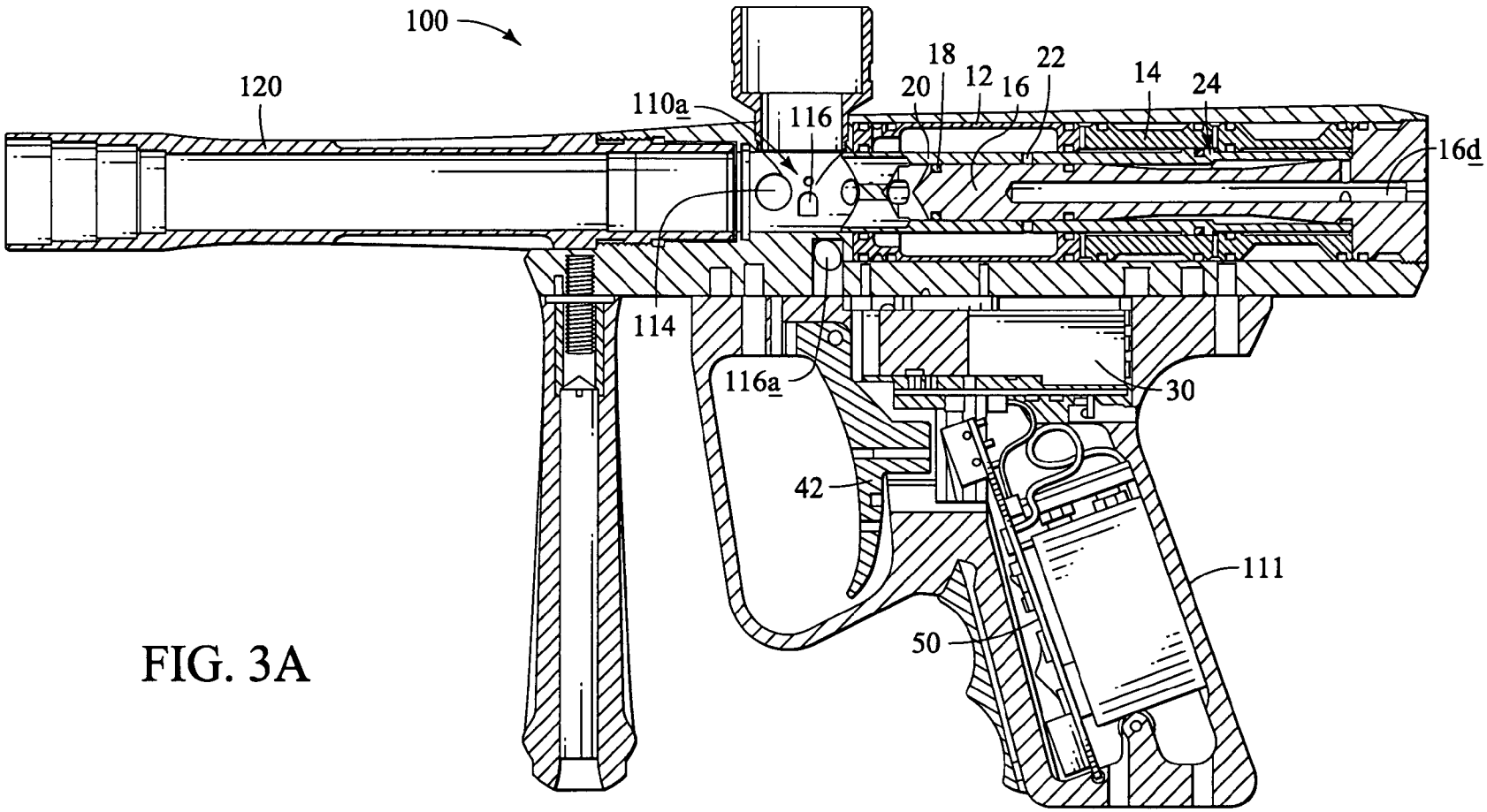
FIG. 3A is a cross-sectional side view of a paintball gun employing the paintball gun body and pneumatic assembly shown in FIG. 1A.
Figure 3B:
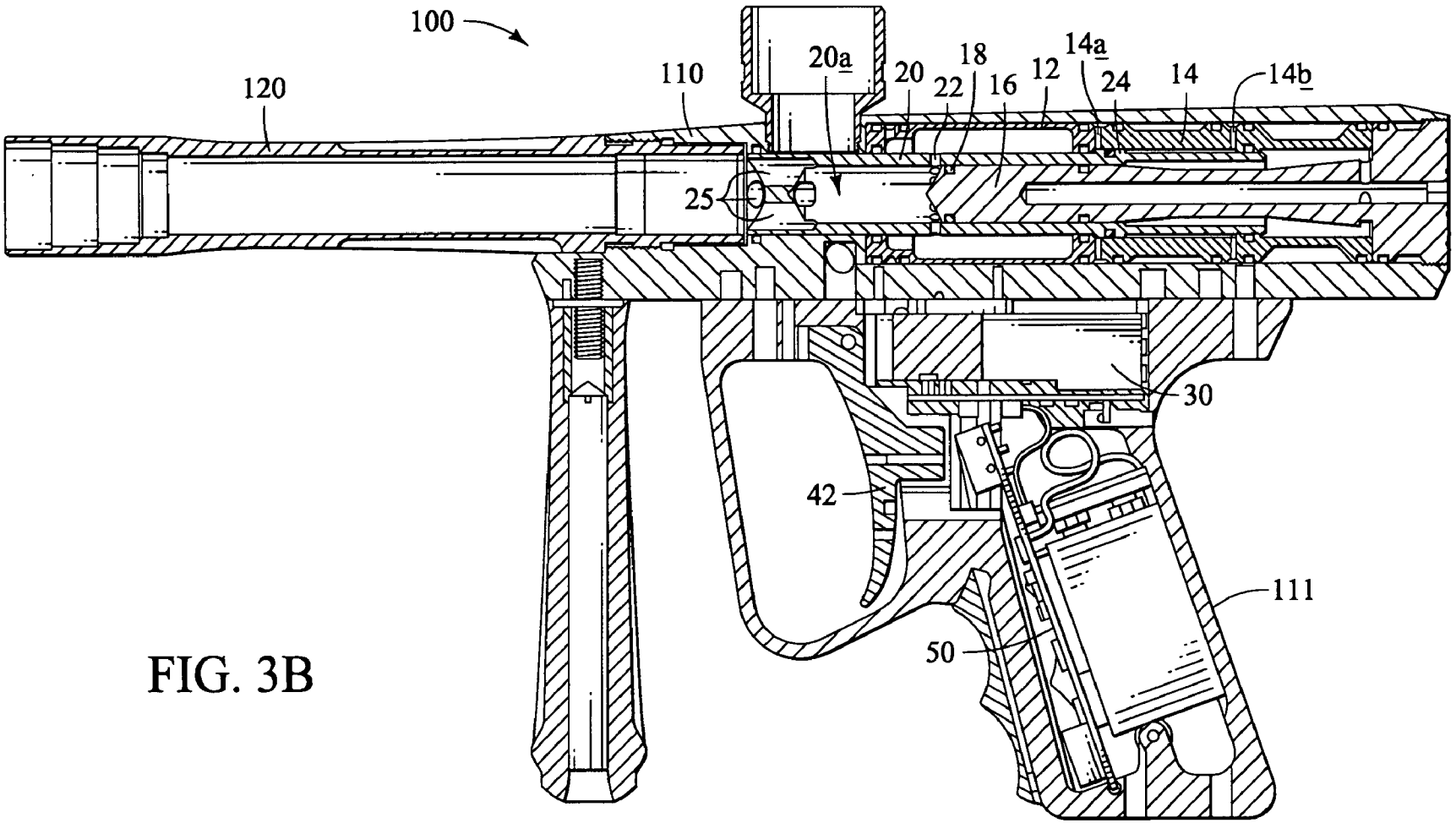
FIG. 3B is a cross-sectional side view of a paintball gun employing the paintball gun body and pneumatic assembly shown in FIG. 1B.

Referring now to FIGS. 3A and 3B, operation of a paintball gun 100 employing the pneumatic assembly 10 shown in FIGS. 1A through 2B is as follows. When the bolt 20 is rearward, a paintball (not shown) is permitted to drop into the breech area 110*a* of the paintball gun body 110. A mechanical or electrical pneumatic valve 30 (e.g., an electronic solenoid valve) preferably initiates a firing operation in response to a pull on the trigger 42. During the firing operation, the pneumatic piston 24 moves forward under control of the pneumatic valve 30 by directing compressed gas to a rearward cylinder port 14*b* while venting compressed gas from a forward cylinder port 14*a*.

The bolt 20 is carried forward by the forward movement of the pneumatic piston 24. As the bolt 20 moves forward, the paintball is loaded into a firing position in a barrel 120, which communicates with the breech area 110*a* of the paintball gun body 110. At the same time, the bolt ports 22 slide past the sealing member 18 and an internal chamber 20*a* of the bolt 20 is exposed to the compressed gas in the compressed gas storage chamber 12. Compressed gas thereby flows through the bolt ports 22, into the bolt 20, and through gas release ports 25 to launch the paintball.

According to this embodiment, the bolt 20 of the pneumatic paintball gun 100 preferably provides the firing mechanism. More specifically, the bolt ports 22, formed through the bolt wall 21 at a predetermined position along the bolt 20, are preferably configured to selectively permit and prevent compressed gas from entering the forward bolt area 20*a*. This is preferably accomplished by positioning the ports 22 in a desired relation with respect to the sealing member 18. When the bolt 20 is open, a sealing engagement between the bolt 20 and the sealing member 18 preferably prevents compressed gas from entering the ports 22. When the bolt 20 closes, however, the ports 22 preferably slide past the sealing member 18 and transmit compressed gas from the compressed gas storage area 12 into the forward bolt chamber 20*a*. The compressed gas then flows out the release ports 25 to launch a paintball.

In embodiments in which the bolt 20 is slidably mounted on a valve stem 16, a sealing member 18 (such as an O-ring, plug, or any other sealing structure) is preferably arranged at a forward end 16*a* of the valve stem 16. The sealing member 18 thereby preferably prevents compressed gas from entering the bolt 20 from the compressed gas storage area 12 until the bolt 20 reaches a predetermined forward position. As the bolt 20 approaches its predetermined forward position, the bolt ports 22 slide past the sealing member 18 and expose an internal bolt chamber 20*a* to compressed gas from the storage chamber 12.

It should be noted, however, that many alternative embodiments are possible without departing from the inventive principles disclosed herein. In one alternative embodiment, for example, a sealing member can be arranged in communication with an external surface 21*b* (see FIG. 1B) of the bolt 20. As in the earlier embodiment, the sealing member (not shown) could be configured to prevent compressed gas from entering the bolt 20 from a compressed gas storage area 12 until the bolt 20 reaches a closed position. As the bolt closes, the gas entry ports 22 preferably slide past the sealing member to permit compressed gas to enter the bolt 20 to launch the paintball from the marker.

Referring to FIGS. 1A-3B, movement of the bolt 20 is preferably accomplished using an electronic solenoid valve 30. The bolt 20 can, for instance, include two, oppositely arranged piston surface areas 24A, 24B formed on a rearward portion of the bolt 20. The solenoid valve 30 can then be configured to alternately supply compressed gas to and vent compressed gas from communication with the two surface areas 24A, 24B. More particularly, compressed gas is preferably supplied from the solenoid valve 30 to a forward surface area 24A through a forward port 14*a* and vented from a rearward surface area 24B through a rearward port 14*b* to move the bolt 20 to a rearward position. Compressed gas is preferably supplied to the rearward surface area 24B through the rearward port 14*b* and vented from the forward surface area 24A through a forward port 14*a* to move the bolt 20 to a forward position.

Although this configuration preferably uses a single, four-way solenoid valve, various types, numbers, and configurations of solenoid valves can be used to shuttle the bolt between a forward and rearward position. In one alternative embodiment, for instance, pressure from a constant supply of compressed gas (or a spring or other biasing member applying a known force) can be provided to a first piston surface area, with compressed gas being selectively supplied through a three-way solenoid valve to an opposite surface having a sufficient area to operate the bolt. Furthermore, the bolt could be connected to a separate pneumatic piston rather than having piston surface areas formed directly thereon.

Figure 4:
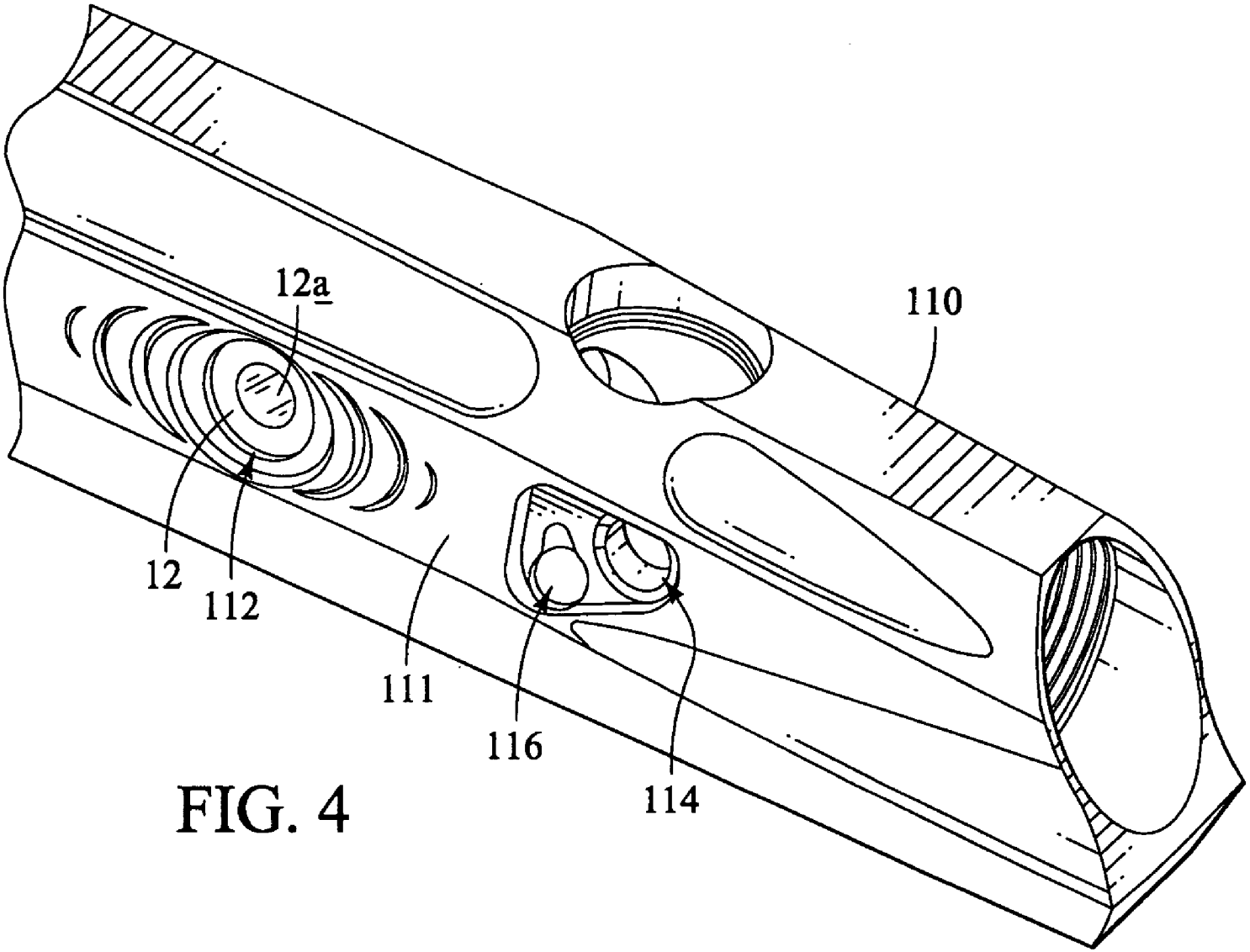
FIG. 4 is a perspective view of a paintball gun body illustrating further principles of the present invention.

Referring now to FIGS. 3A and 4, a paintball gun body 110, can embody various additional inventive principles. In particular, the paintball gun body 110 shown in FIG. 4 preferably includes a viewing aperture 112 arranged through a lateral wall 111 of the paintball gun body 110. A detent aperture 114 can be provided for placement of a ball detent to prevent paintballs from double feeding. An eye aperture 116 can also be provided through the body wall 111 for the positioning of an electronic eye (not shown). The electronic eye preferably senses the presence or absence of a paintball in the breech area 110*a* (or the transition of a paintball into the breech area 110*a*) of the paintball gun body 110 to prevent misfiring or breaking a paintball in the breech. An internal wiring aperture 116*a* can also be provided from the breech area 110*a* to a grip 111 of the paintball gun 100 to permit attachment of the electronic eye to a circuit board 50 of the paintball gun 100 without any external wiring.

According to yet another aspect of this invention, a plurality of compressed gas storage chambers 12 can be provided, with each of the compressed gas storage chambers 12 having a different internal volume from the others. Different internal volumes may be desirable to permit firing of a paintball at a desired velocity using a different gas pressure. Selecting an appropriate chamber volume can also improve gas efficiency. In one embodiment, each of the plurality of compressed gas storage chambers 12 can be provided having a different color, an externally visible sticker or markings, or other size indicator(s) 12*a* to represent an internal volume of the chamber 12. When the chamber 12 is arranged in the paintball gun body 110, this indicator 12*a* can preferably be viewed through the viewing aperture 112 to permit quick visual determination of the internal volume of the compressed gas storage chamber 12. The indicators 12*a* can, for instance, indicate an actual volume, a relative volume (as compared to other chambers or some independent reference value), or both.

Figure 5:
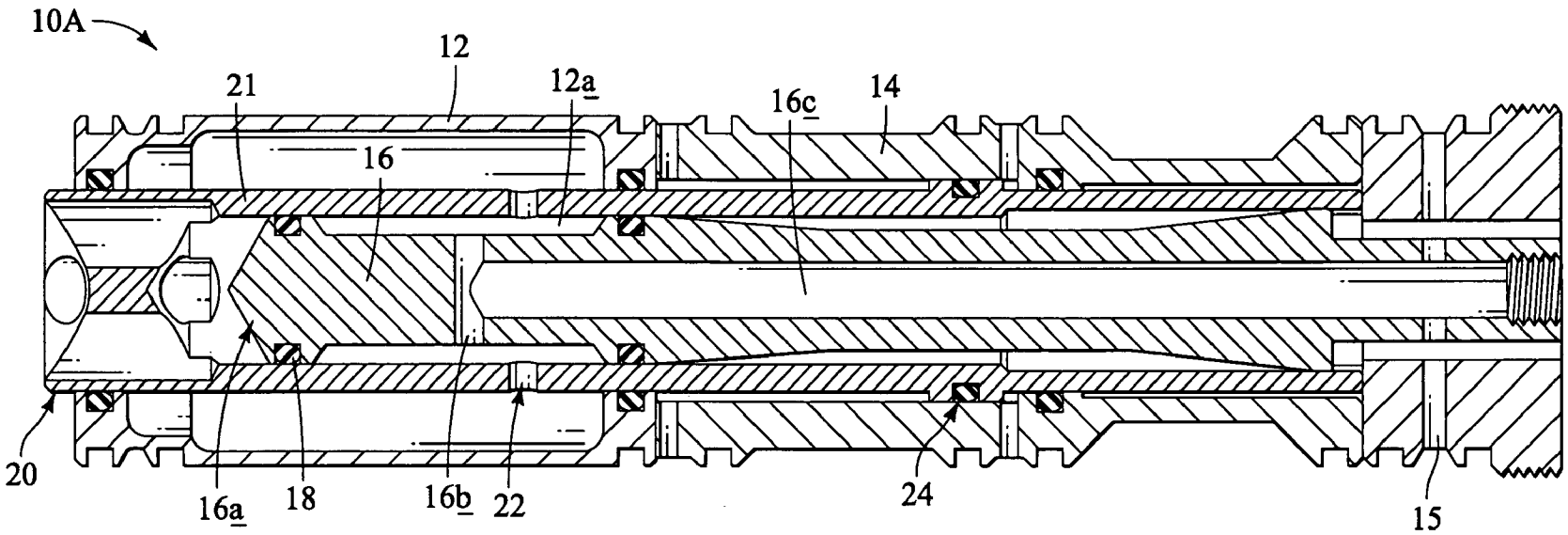
FIG. 5 is a cross-sectional view of a pneumatic assembly for a paintball gun according to another embodiment employing principles of the present invention.

FIG. 5 is a cross-sectional view of a pneumatic assembly 10A for a paintball gun 100 (see FIG. 3A) constructed according to an alternative embodiment of the invention. Referring to FIG. 5, a pneumatic assembly 10A according to this embodiment preferably provides a fixed-volume firing chamber 12 to reduce gas consumption and increase the overall efficiency of the paintball gun 100. As in the embodiments described previously, the pneumatic assembly 10A preferably includes a compressed gas storage chamber 12 and a pneumatic cylinder 14 having a piston 24 slidably arranged therein. A bolt 20 is preferably disposed through the compressed gas storage chamber 12 and coupled to (or formed integrally with) the piston 24. The bolt 20 can be slidably mounted on a valve stem (or bolt guide) 16. The valve stem 16 preferably comprises a sealing member 18 arranged on a forward end 16*a* thereof. The bolt 20 preferably comprises one or more ports 22 arranged through a lateral sidewall 21 of the bolt 20.

Unlike the previous described embodiments, however, compressed gas is preferably supplied to the compressed gas storage chamber 12 through the valve stem 16. The valve stem 16 of this embodiment preferably receives compressed gas into an internal passageway 16*c* from a compressed gas source (such as a regulator) through an input port 15. The input port 15 can be arranged in the rearward end of the pneumatic assembly 10A. The compressed gas travels down the passageway 16*c* and through output ports 16*b* into an intermediate area 12*a* located between the bolt 20 and the valve stem 16.

When the bolt 20 is in a rearward position, compressed gas is allowed to travel from the intermediate area 12*a* into the compressed gas storage chamber 12 through the bolt ports 22. When the bolt transitions to its forward position, however, the supply of compressed gas to the compressed gas storage chamber 12 is preferably cut off (or restricted) as the bolt ports 22 slide past the sealing member 18. At this same time, the compressed gas in the storage chamber 12 is released through the bolt ports 22 into and through the bolt 20. In this manner, a controlled amount of compressed gas can be used to launch a paintball from the paintball gun 100 and gas efficiency can be improved.

Figure 6:
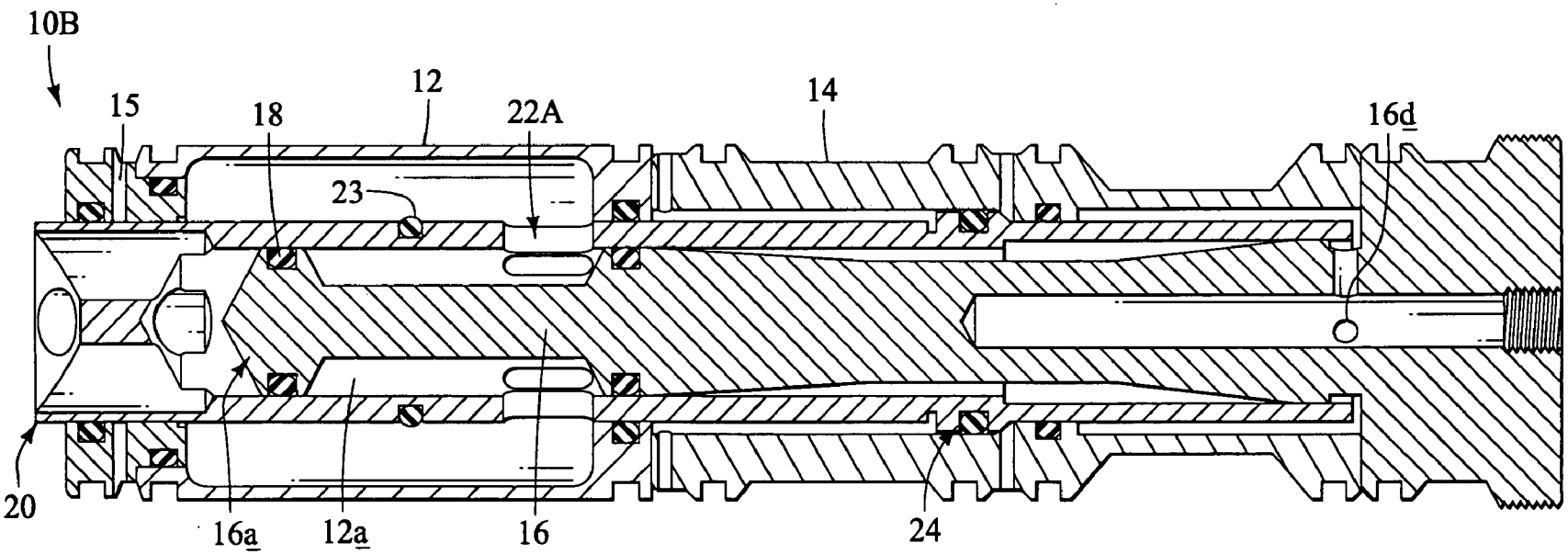
FIG. 6 is a cross-sectional view of a pneumatic assembly for a paintball gun according to a still further embodiment employing principles of the present invention.

FIG. 6 is a cross-sectional view of a pneumatic assembly 10B for a paintball gun 100 (see FIG. 3A) according to yet another embodiment of the present invention. Referring to FIG. 6, a pneumatic assembly 10B according to this embodiment also preferably includes a compressed gas storage chamber 12 and a pneumatic cylinder 14 having a piston 24 slidably arranged therein. A bolt 20 is preferably disposed through the compressed gas storage chamber 12 and coupled to (or formed integrally with) the piston 24. The bolt 20 can be slidably mounted on a valve stem (or bolt guide) 16. The valve stem 16 preferably comprises a sealing member 18 arranged on a forward end 16*a* thereof. The bolt 20 preferably comprises one or more ports 22 arranged through a lateral sidewall 21 of the bolt 20. With the bolt 20 in a rearward position, compressed gas is preferably supplied to the compressed gas storage chamber 12 through an input port 15 located near a forward end of the pneumatic assembly 10B. A vent 16*d* can be provided to release pressure behind the bolt 20.

Figure 7:
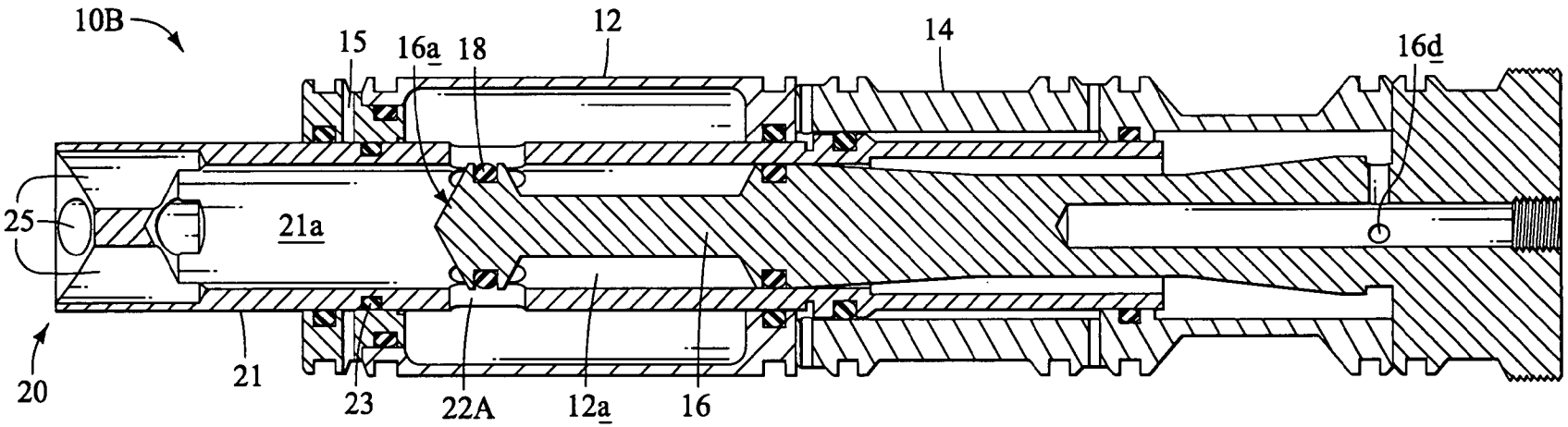
FIG. 7 is a cross-sectional view of the pneumatic paintball gun assembly of FIG. 6, showing the bolt in a forward (e.g., closed) position.

FIG. 7 is a cross-sectional view of the pneumatic assembly 10B of FIG. 6, showing the bolt 20 in a forward position. Referring to FIG. 7, when the bolt 20 approaches its forward position, a sealing member 23 arranged around a lateral sidewall 21 of the bolt 20 preferably seals off the compressed gas storage chamber 12 from the gas input 15 (or restricts a flow of compressed gas into the storage chamber 12). At the same time, at least a portion of the bolt ports 22A slide past the sealing member 18 arranged on the valve stem 16, thereby releasing compressed gas through the bolt 20 and out of the bolt ports 25 to launch a paintball.

Compressed gas supplied through the gas input 15 can also be used to assist in opening the bolt 20 following a firing operation to provide a faster loading operation. For example, in the pneumatic assembly 10B shown in FIG. 7, differential pressures are applied to the sealing member 23 after the compressed gas is evacuated from the storage area 12. The differential pressures create a rearward force on the sealing member 23 that assists in opening the bolt 20 during a loading operation. This results in a faster loading operation and can thereby enable an increased firing rate.

According to still other principles of this invention, an increased area can be provided for supplying the compressed gas for the firing operation without increasing the external dimensions of the firing chamber 12. In the pneumatic assembly 10B of this embodiment, for example, the bolt ports 22A are preferably formed so as to enable an intermediate area 12*a* located between the internal bolt surface 21*a* and the valve stem 16 to supply a portion of the compressed gas for the launching operation. More particularly, with the bolt 20 arranged in its forward position, the bolt ports 22A are preferably formed as slots, holes, or other shapes that extend from one side of the sealing member 18 to the other, thereby enabling communication between the intermediate area 12*a*, the compressed gas storage chamber 12, and the bolt release ports 25. Alternatively, additional, separate bolt ports can be provided to permit communication between the intermediate area 12*a* and the compressed gas storage chamber 12. In this manner, the size of the compressed gas storage chamber 12 can be effectively enlarged without changing its external dimensions. By increasing the volume of the compressed gas storage chamber 12, a lower chamber pressure is required to fire the paintball at the desired velocity.

Figure 8:
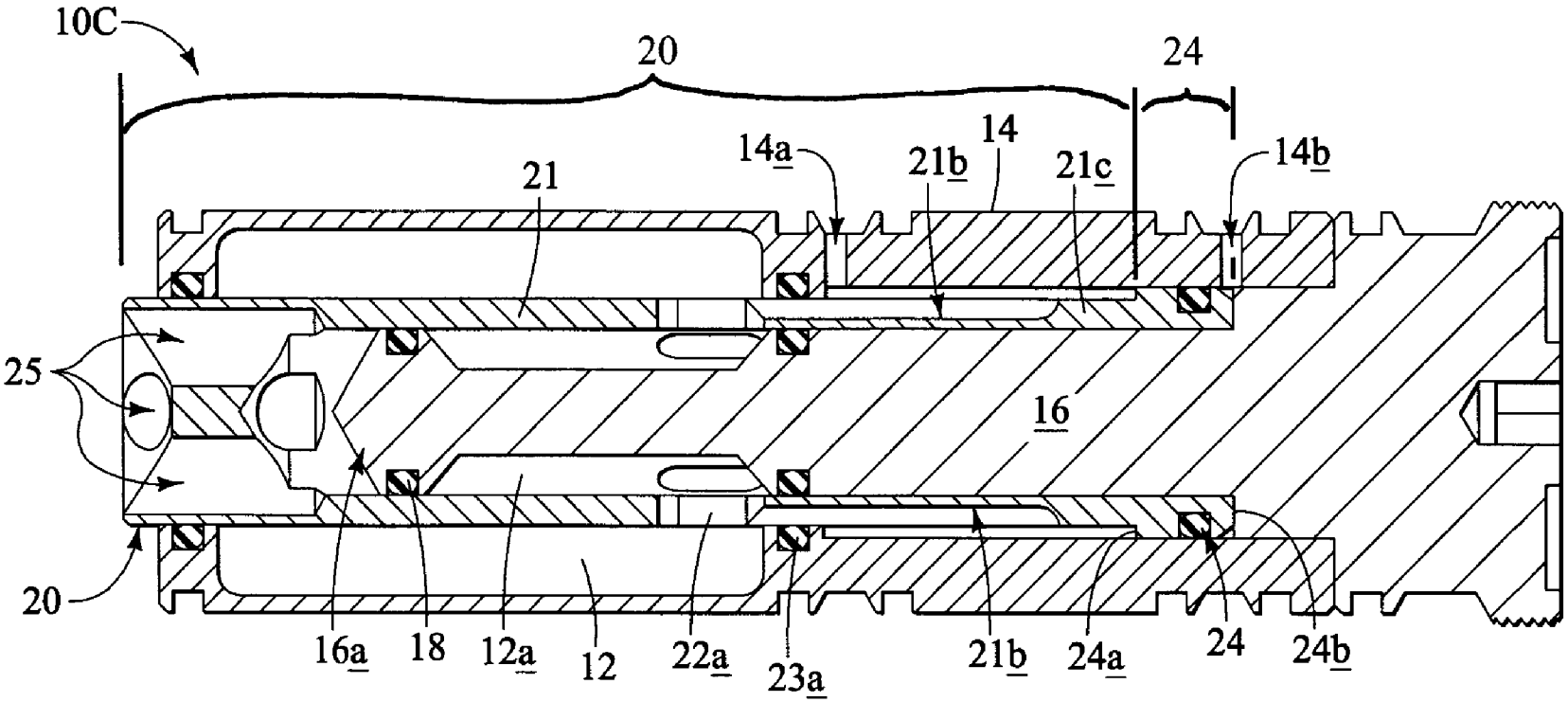
FIG. 8 is a cross-sectional side view of a pneumatic assembly for a paintball gun in a loading position according to a further embodiment illustrating additional inventive concepts.
Figure 9:
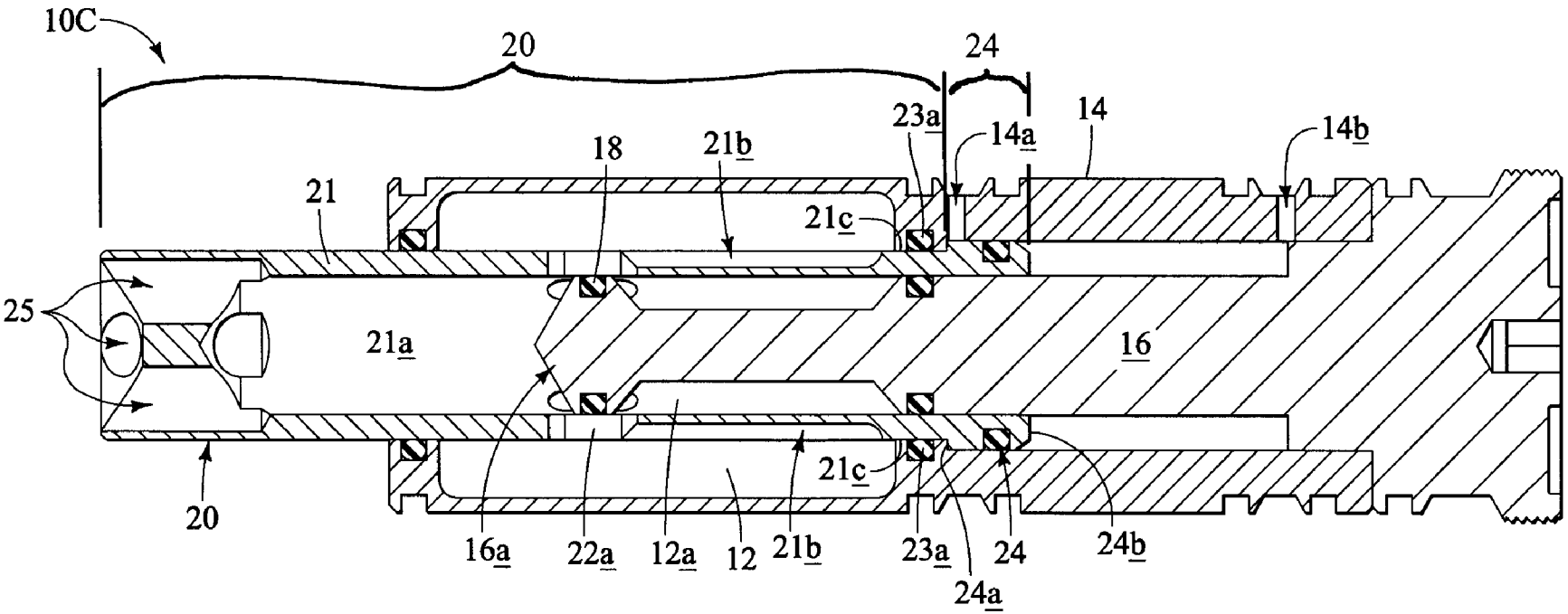
FIG. 9 is a cross-sectional side view of the pneumatic paintball gun assembly of FIG. 8 showing the assembly in a firing position.

Yet another embodiment having additional inventive principles is shown in FIGS. 8 and 9. Referring to FIGS. 8 and 9, a pneumatic assembly 10C for a paintball gun according to this embodiment preferably includes a compressed gas storage chamber 12 and a pneumatic cylinder 14. The pneumatic cylinder 14 preferably houses a piston 24 slidably arranged therein. A bolt 20 is preferably disposed through the compressed gas storage chamber 12 and coupled to (or formed integrally with) the piston 24. The bolt 20 can be slidably mounted on a valve stem (or bolt guide) 16. The valve stem 16 preferably comprises a sealing member 18 arranged on a forward end 16*a* thereof. The bolt 20 preferably comprises one or more ports 22*a* arranged through a lateral sidewall 21 of the bolt 20.

Referring to FIG. 8, with the bolt 20 in a rearward position, compressed gas is preferably supplied to the compressed gas storage chamber 12 from the forward port 14*a* of the pneumatic cylinder 14. More specifically, when the bolt 20 is arranged in an open (e.g., rearward) position, the port 14*a* preferably supplies compressed gas to the compressed gas storage chamber 12 via channels 21*b* arranged along an external sidewall of the bolt 20. The port 14*a* also preferably supplies compressed gas to the pneumatic piston 24 to hold the bolt 20 open.

FIG. 9 is a cross-sectional view of the pneumatic assembly 10C of FIG. 8, showing the bolt 20 in a forward position. Referring to FIG. 9, a rearward surface area 24*b* of the piston 24 is preferably larger than a forward surface area 24*a* of the piston 24. Accordingly, when compressed gas is supplied to a rearward end of the piston 24 through the rearward pneumatic cylinder port 14*b*, the bolt 20 is driven forward. A sealing or flow restriction member 23*a* is preferably arranged in an inner wall of the pneumatic assembly surrounding a lateral sidewall 21 of the bolt 20. As the bolt 20 approaches its forward position, the sealing or flow restriction member 23*a* preferably engages the rearward portion 21*c* of the lateral sidewall 21 to seal off, or substantially restrict, the flow of compressed gas into the compressed gas storage chamber 12 from the gas input 14*a* through the channels 21*b*. At the same time, a portion of the bolt ports 22*a* preferably slide past the sealing member 18 arranged on the valve stem 16, thereby releasing compressed gas from the compressed gas storage chamber 12 and extended chamber area 12*a* into the forward area of the bolt 20 and out of the bolt ports 25 to launch a paintball.

When a firing operation is completed, compressed gas supplied to the rearward area of the pneumatic cylinder 14 is preferably vented away through port 14*b*, thereby relieving the pressure applied to the rearward surface area 24*b* of the piston 24. Port 14*a* preferably receives a constant supply of compressed gas from a compressed gas source and therefore preferably applies a constant force to the forward surface area 24*a* of the piston 24. Accordingly, as the pressure is relieved from the rearward surface area 24*b*, the bolt 20 is driven rearward, thus opening the channels 21*b* to receive compressed gas and to thereby supply compressed gas to the compressed gas storage chamber 12. The bolt ports 22*a* are also drawn back across the sealing member 18 to prevent compressed gas from the compressed gas storage area 12 from escaping through the forward area of the bolt 20.

In this manner, a three-way solenoid valve (not shown) can be employed to operate the pneumatic assembly by controlling the supply and release of compressed gas to the rearward pneumatic cylinder port 14*b*. Use of a three-way solenoid valve can improve the gas efficiency of the pneumatic assembly. Compressed gas can further be conserved by sealing off the supply of compressed gas to the compressed gas storage area during the firing operation. The size of the pneumatic assembly can also be reduced as compared to other embodiments by utilizing the same port 14*a* to supply compressed gas to the piston 24 and to the compressed gas storage chamber 12. Of course, alternative embodiments may also be employed to accomplish the primary inventive objects of the present invention.

Having described and illustrated various principles of the present invention through descriptions of exemplary embodiments thereof, it will be readily apparent to those skilled in the art that these embodiments can be modified in arrangement and detail without departing from the inventive principles made apparent herein. The claims should therefore be interpreted to cover all such variations and modifications.

What is claimed is:

1. A pneumatic assembly for a paintball gun, comprising:

a piston slidably mounted in a pneumatic chamber;

a first port arranged in a forward end of the pneumatic chamber, wherein said first port is configured to supply compressed gas from a compressed gas source to a first chamber area, and wherein said first chamber area is arranged in communication with a first surface area of the piston such that compressed gas supplied to the first chamber area supplies a force on the first piston surface area that urges the piston in a rearward direction;

a second port arranged in the pneumatic chamber, wherein said second port is connected in fluid communication with a solenoid valve to selectively supply compressed gas into a second chamber area, wherein the second chamber area is arranged in communication with a second surface area of the piston such that compressed gas supplied to the second chamber area supplies a force to the second piston surface area that urges the piston in a forward direction;

a channel arranged to provide fluid communication between the first chamber area and a compressed gas storage area when the pneumatic assembly is in a first configuration, such that compressed gas supplied to the first chamber area flows into the compressed gas storage area when the pneumatic assembly is in the first configuration to provide the compressed gas for a firing operation of the paintball gun; and a flow restriction member arranged proximal to said channel, wherein said flow restriction member restricts said fluid communication between the first area and the compressed gas storage area when the pneumatic assembly is in a second configuration, such that compressed gas from the first chamber area is at least substantially prevented from entering the compressed gas storage area when the pneumatic assembly is in the second configuration but not when the pneumatic assembly is in the first configuration.

2. A pneumatic assembly according to claim 1, further comprising a bolt coupled to the piston.

3. A pneumatic assembly according to claim 2, wherein said channel is arranged along a sidewall of the bolt and extends from a bolt port to a rearward portion of the bolt near the first piston surface area.

4. A pneumatic assembly according to claim 3, wherein said flow restriction member comprises a sealing member arranged in a housing of the pneumatic assembly surrounding a periphery of the bolt to prevent compressed gas from entering the channel when the bolt is disposed in a closed position.

5. A pneumatic assembly according to claim 2, wherein one or more bolt ports are configured to enable compressed gas from an intermediate area between the bolt and a valve stem to supply compressed gas to a forward internal area of the bolt during a firing operation.

6. A pneumatic assembly according to claim 5, wherein one or more of the bolt ports comprise a length greater than a width of a sealing member arranged on a forward end of the valve stem.

7. A pneumatic assembly according to claim 1, wherein the first port is arranged in substantially constant communication with a compressed gas source to provide a substantially constant supply of compressed gas to the first chamber area.

8. A pneumatic assembly according to claim 1, wherein said first surface area of the piston is smaller than said second surface area of the piston.

9. A pneumatic assembly according to claim 8, wherein compressed gas supplied to the second surface area of the piston from the solenoid valve provides a sufficient force to overcome a force applied to the first surface area of the piston to initiate a firing operation of the pneumatic assembly.

10. A pneumatic assembly for a paintball gun, comprising:

a pneumatic housing comprising a compressed gas storage chamber and a pneumatic piston housing, wherein said pneumatic piston housing comprises first and second compressed gas ports configured to receive compressed gas and supply compressed gas into said pneumatic piston housing;

a piston slidably arranged in the pneumatic piston housing, said piston having a first surface area arranged in a first area of the pneumatic piston housing in fluid communication with the first compressed gas port such that compressed gas supplied into the first area of the pneumatic piston housing through the first port supplies a rearward force on the first surface area that urges the piston rearward, and a second surface area arranged in a second area of the pneumatic piston housing in fluid communication with the second compressed gas port such that compressed gas supplied into the second area of the pneumatic piston housing supplies a forward force on the second surface area that urges the piston forward; and a channel configured to communicate compressed gas from the first area to the compressed gas storage chamber when said piston is arranged in a rearward position, such that compressed gas supplied into the first area of the pneumatic piston housing also fills the compressed gas storage chamber.

11. A pneumatic assembly according to claim 10, further comprising a flow restriction member configured to restrict the flow of compressed gas from the first area to the compressed gas storage chamber when said piston is arranged in a forward position but not when the piston is arranged in a rearward position.

12. A pneumatic assembly according to claim 10, further comprising a bolt coupled to the piston, wherein the channel is arranged along a sidewall of the bolt and extends from a bolt port towards a rearward end of the bolt.

13. A pneumatic assembly according to claim 12, further comprising a sealing member arranged to engage an external bolt surface, wherein the sealing member substantially prevents a flow of compressed gas from the first area into the channel when the bolt is in a forward position but does not prevent the flow of compressed gas into the channel when the bolt is in a rearward position.

14. A pneumatic assembly according to claim 10, wherein the first surface area is smaller than the second surface area.

15. A pneumatic assembly according to claim 14, wherein the first area receives a substantially constant supply of compressed gas from the first port and wherein the second area selectively receives a supply of compressed gas from a solenoid valve to operate the pneumatic assembly.

* * * * *